United States Patent [19]

Lanzen

[11] Patent Number: 5,005,791

[45] Date of Patent: Apr. 9, 1991

[54] HANGER FOR OPEN BAG

[76] Inventor: Richard G. Lanzen, 1843 38th St., Moline, Ill. 61265

[21] Appl. No.: 516,192

[22] Filed: Apr. 30, 1990

[51] Int. Cl.[5] ..... B65B 67/12

[52] U.S. Cl. ..... 248/99

[58] Field of Search ..... 248/95, 97, 99, 100, 248/101, 284, 150; 220/404, 908; 383/33, 34; 141/314, 391

[56] References Cited

U.S. PATENT DOCUMENTS

| | | | |
|---|---|---|---|
| 3,132,794 | 5/1964 | Frazier | 248/99 |
| 3,260,488 | 7/1966 | Kliewer | 248/99 |
| 3,779,496 | 12/1973 | Welles | 248/99 |
| 4,695,020 | 9/1987 | Collins | 248/100 |
| 4,750,695 | 6/1988 | Greenhouse | 248/99 |
| 4,838,504 | 6/1989 | Bittenbinder | 248/100 |
| 4,881,706 | 11/1989 | Sedlik | 248/150 |

*Primary Examiner*—Ramon O. Ramirez
*Assistant Examiner*—Robert A. Olson
*Attorney, Agent, or Firm*—Glenn H. Antrim

[57] ABSTRACT

A bag holder has a base to be attached to a vertical surface and has two hinged arms to be latched perpendicular to the base in useful positions for holding an open bag. Nestable spaces for the arms are provided within the surface of the base, and hinges connecting the arms to the base permit the arms to be turned from the nestable spaces to the useful positions. The upper edge of each arm is contoured to provide an intermediate upright portion about which a loop, or handle, of a bag is suspended. The arms are biased to be urged to the nestable positions, and latching means between the base and the arms retain the arms in the useful positions.

1 Claim, 1 Drawing Sheet

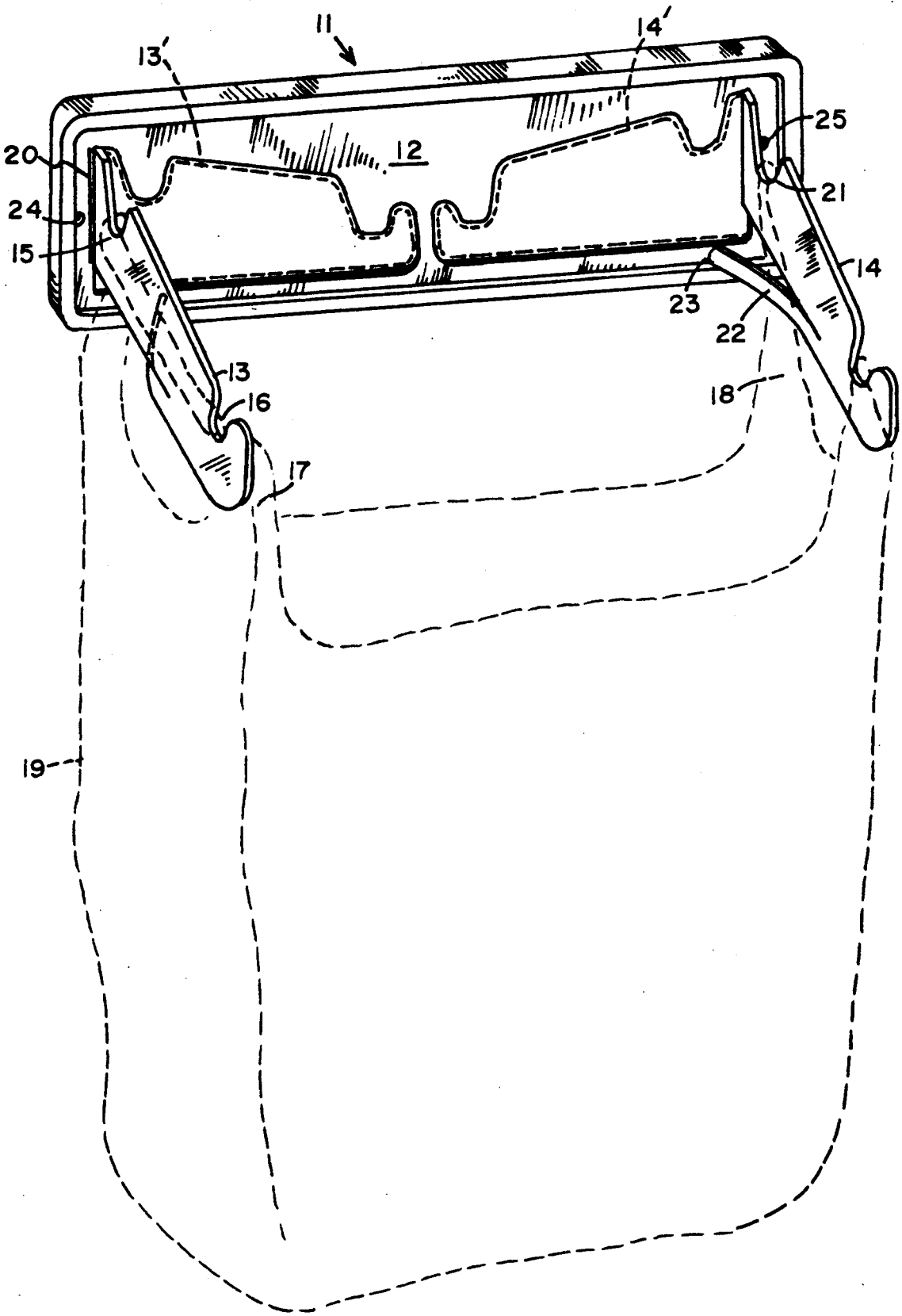
11
13'
14'
12
20
24
15
25
21
14
23
22
13
16
18
17
19

HANGER FOR OPEN BAG

BACKGROUND OF THE INVENTION

This invention pertains to holders, and particularly to a holder having a mounting base to which is attached spaced arms for hanging a bag by its handles in an open position for filling.

A bag-holding article is shown in U.S. Pat. No. 4,838,504 issued to Stefan Bittenbinder on June 13, 1989. A plane, rectangular base has approximate each end a groove for receiving a respective one of a pair of separated supporting arms and has a hole through each end for a mounting screw. Each of the arms has an inner end contoured to fit within one of the grooves for retaining the arm removably but rigidly and perpendicularly to the base, and each arm has a front hook and a rear hook over or around which a handle of a bag to be filled is looped, the arms and the hooks on each arm being spaced apart the distances required to hold a suspended bag open.

SUMMARY OF THE INVENTION

According to this invention, a bag holder, or hanger, has a molded, generally rectangular base that not only supports two spaced arms but that also has an opening adjacent each arm for receiving the arms in nestable positions. Compactness obtained by using the nestable positions facilitates packaging the bag hangers for marketing and is desirable when the hangers are not being used after they are mounted. The present bag hangers are economical to manufacture because both the mounting bases and the arms can be fabricated from plastic using a single mold, or if the mounting bases are plates cut by machines from larger plates, the arms are cut from the mounting plates to provide the openings for nesting.

An end of each arm is hinged near a respective end of the base and adjacent a cutout portion. A latching member adjacent each hinged portion is positioned between the base and the respective arm to function as a brace for holding the arm substantially perpendicular to the mounting plate after the arm is turned about its hinged portion from its nestable position to its useful position.

BRIEF DESCRIPTION OF THE DRAWING

The single FIGURE is a perspective view of a molded hanger of this invention with the arms in their useful positions shown in solid lines, and in ther nesting position shown in dashed lines.

DESCRIPTION OF THE PREFERRED EMBODIMENT

The bag hanger 11 shown in the drawing is preferably molded from polyethylene by usual injection processes. An elongated, generally rectangular mounting base 12 is to be installed horizontally for extending perpendicularly outwardly two identical supporting arms 13 and 14. Each of the arms 13 or 14 has an inner end hinged near a respective end of the base 12, and has spaced notches 15 and 16 extending downwardly from its upper edge, the notch 15 being spaced a short distance form the hinged end and the notch 16 being a short distance from the opposite end. The notches 15 and 16 in the upper edge of each arm defines an intermediate upright about which a handle of a bag is to be looped. To suspend a bag 19, the central portions of the bag handles 17 and 18 are placed individually up and over the intermediate inside surfaces of the arms 13 and 14 and through the notches 15 and 16 to position the central portions of the handles outside the intermediate uprights. The arms 13 and 14 and the respective notches 15 and 16 are spaced apart far enough to hold the top of the suspended bag 19 open.

The base 12 and the supporting arms 13 and 14 are molded as a unit with the arms in usual nestable positions shown by the dashed lines 13' and 14'. A wider end of each of the supporting arms 13 and 14 is molded within the mounting 12 approximate a respective end of the base by a contoured, relatively thin strip of the plastic material for a hinge 20 or 21. A gap of sufficient width to prevent binding is provided along the upper edge, the other end and the bottom edge of each of the arms 13 and 14. The resilient strips of plastic for the hinges 20 and 21 tend to resume their original molded shapes and therefore also function like springs to urge the arms 13 and 14 toward the nestable positions 13' and 14'. Each of the hinges 20 and 21 extends along the inner edge of the respective arms 13 and 14 from the upper edge, but does not extend quite to the lower edge where sufficient space must be left for a latching finger 22.

To form the finger 22, a narrow gap extends about two-thirds of the length of the lower edge of each of the arms 13 and 14 from the hinged edge and is spaced only a sufficient distance above the lower edge to form a strip, or finger 22. The finger 22 has sufficient flexibility to permit the free end to be moved inward against the base 12 while the respective arm 13 or 14 is in a perpendicular, useful position, and also has sufficient rigidity for functioning as a brace to hold the arm in the useful position. the length of the finger 22 must be sufficient to extend somewhat beyond the axis of the respective hinge, the length determining the outward extent of the gap below the lower edge of the arm 13 or 14.

For each arm, an indentation 23 within the front face of the base 12 just below the cutout of the arm receives the free end of the finger 22 for retaining the arm in the perpendicular, useful position. The latching finger or brace 22 must have sufficient thinness and length to permit positioning manually the free end in a indentation 23 that may be 15 to 20 mm from the axis of the hinge. The elasticity of the hinges 20 and 21 positively forces the free end of the fingers 22 into the respective indentations 23. For positioning the arms 13 and 14 at different angles with respect to the base 12, a plurality of indentations in a horizontal row may be provided.

For mounting, such as on the inside surface of a cabinet door under a kitchen sink, holes 24 and 25 for screws are through the mounting base 12 close to opposite ends of the base. When the supporting arms 13 and 14 are not being used, they may be turned substantially horizontally about the respective hinges 20 and 21 from their perpendicular useful positions to their respective nestable positions 13' and 14' within the openings defined by the gaps molded about the supporting arms.

For molding, corners are preferably rounded, and by turning backward the edges of the base 12 and of the arms 13 and 14 and by using conventional reinforcing ribs, the body can generally be quiet thin. The saving of material resulting from cutting the arms 13 and 14 from the base 12 to provide openings for nesting, and the advantages of the nesting feature can also be obtained by the more expensive method of machining and by the use of conventional, discrete hinges. The upper edges of the supporting arms 13 and 14 need not be tapered from the hinge to the free end as shown, and the contour of the upper edges may differ to provide the spaced notches or depressions 15 and 16 and the intermediate, upright portions for retaining handles of bags. Alternately, the latching fingers 22 might be cut out of the base 12 such that the free ends could be positioned against the arms 13 and 14, or other conventional latching or indexing means could be used to latch the arms in the useful positions.

I claim:

1. A holder for supporting bags in an open position, said bags having opposite loops for handles, said holder having a base and two supporting arms, means for attaching said supporting arms perpendicularly to said base, means for mounting said base for extending said arms at the same level, said upper edges of said arms being contoured for suspending said loops about respective intermediate portions of said arms, the distance along each of said intermediate portions and the distance between said arms being sufficient to hold open the top of said bags having said loops about said intermediate portions, the improvement comprising a hinge as said means for attaching each of said supporting arms to said base, said hinges permitting only horizontal turning of said arms, an intermediate portion of said base contiguous each of said hinges having a nestable space of sufficient area intermediate said hinges to receive the contiguous one of said arms in a nestable position within said base, said hinges being biased to urge said arms into said respective nestable spaces, a stiffly resilient finger as an integral portion of each of said arms, each of said fingers being formed by a gap a short distance from the lower edge of said respective arm, said gap extending for a substantial distance from the hinged end of said respective arm outwardly along said lower edge thereof, an end of each of said fingers adjacent said respective hinge being movable to a position on said base to retain said respective arm in a useful position substantially perpendicular to said base, and the other end of each of said fingers being integrally connected to said respective arm.

* * * * *